US007937855B2

(12) United States Patent
Faber et al.

(10) Patent No.: US 7,937,855 B2
(45) Date of Patent: May 10, 2011

(54) SNOWSHOE

(75) Inventors: Guy Faber, Quebec (CA); Richard Faber, Quebec (CA)

(73) Assignee: Faber & Co. Inc., Quebec (CA)

( * ) Notice: Subject to any disclaimer, the term of this patent is extended or adjusted under 35 U.S.C. 154(b) by 747 days.

(21) Appl. No.: 11/970,777

(22) Filed: Jan. 8, 2008

(65) Prior Publication Data

US 2009/0172974 A1 Jul. 9, 2009

(51) Int. Cl.
*A43B 5/00* (2006.01)

(52) U.S. Cl. ..... 36/122; 36/124

(58) Field of Classification Search ..... 36/122–125
See application file for complete search history.

(56) References Cited

U.S. PATENT DOCUMENTS 5,542,197 A * 8/1996 Vincent ..... 36/122
5,740,621 A * 4/1998 Wing et al. ..... 36/122
6,105,281 A * 8/2000 Wing et al. ..... 36/122
6,163,984 A 12/2000 Faber et al.
6,814,360 B2 * 11/2004 Kiniry et al. ..... 280/11.3
7,194,825 B2 * 3/2007 Faber et al. ..... 36/124
7,797,858 B2 * 9/2010 Gallay ..... 36/125
2003/0101623 A1 * 6/2003 Settelmayer ..... 36/124
2006/0213089 A1 * 9/2006 Faber et al. ..... 36/124
2007/0251127 A1 * 11/2007 Gallay ..... 36/122

* cited by examiner

*Primary Examiner* — Marie Patterson
(74) *Attorney, Agent, or Firm* — Fraser Clemens Martin & Miller LLC; J. Douglas Miller

(57) ABSTRACT

The snowshoe defines opposite front and rear ends, opposite first and second sides and opposite top and bottom surfaces and comprises a rigid peripheral frame member comprising a top portion corresponding to the top surface of the snowshoe and a bottom portion corresponding to the bottom surface of the snowshoe and having a frame member thickness defined between the top and bottom portions. The snowshoe also has a decking that is at least semi-rigid and that comprises a central load-bearing portion and a number of tongue members fixed to the load-bearing portion and attached to the frame member whereby the frame member carries the decking. The snowshoe further has a harness pivotally attached to either one of the decking and the frame member for allowing a person's foot to be releasably attached to the snowshoe. The tongue members have a staggered attachment configuration relative to the thickness of the frame member.

11 Claims, 6 Drawing Sheets

SNOWSHOE

FIELD OF THE INVENTION

The present invention relates to snowshoes and more particularly to a snowshoe having a decking which increases the grip of the snowshoe over snow and the overall rigidity of the snowshoe.

BACKGROUND OF THE INVENTION

Some snowshoes include a semi-rigid decking linked to a peripheral frame by means of attachments in the form of tongue members extending from a central, load-bearing portion of the decking to the peripheral frame of the snowshoe. These tongue members usually all extend either over the frame or under it. In all cases, the tongue members will pull on the frame side bars when the decking is loaded by a person's foot, forcing the frame side bars inwardly. This is undesirable, since walking with snowshoes having a frame which flexes during gait is difficult.

SUMMARY OF THE INVENTION

The present invention relates to a snowshoe defining opposite front and rear ends, opposite first and second sides and opposite top and bottom surfaces and comprising:

- a rigid peripheral frame member comprising a top portion corresponding to said top surface of said snowshoe and a bottom portion corresponding to said bottom surface of said snowshoe and having a frame member thickness defined between said top and bottom portions;
- a decking that is at least semi-rigid and that comprises a central load-bearing portion and a number of tongue members fixed to said load-bearing portion and attached to said frame member whereby said frame member carries said decking; and
- a harness pivotally attached to either one of said decking and said frame member for allowing a person's foot to be releasably attached to said snowshoe;

wherein said tongue members have a staggered attachment configuration relative to the thickness of said frame member.

In one embodiment, said frame member is U-shaped and comprises first and second elongated generally parallel side bars respectively located on said snowshoe first and second sides and integrally linked by an arcuate front frame tip portion, said frame member defining a gap near said rear end of said snowshoe between said first and second side bars, said decking defining a free rear edge which is not attached to said frame member at said read end of said snowshoe.

In one embodiment, said decking comprises a toe hole for allowing the person's foot attached to the snowshoe with said harness to extend cyclically under and over said decking by pivoting into and out of said toe hole during gait.

In one embodiment, said harness is pivotally attached to said decking on a toe hole edge portion thereof.

In one embodiment, at least some of said tongue members are spaced-apart tangentially along said frame member and openings are consequently defined between said at least some spaced-apart tongue members.

In one embodiment, a number of said tongue members extend from said load-bearing portion towards said frame member top portion while a number of other said tongue members extend from said load-bearing portion towards said frame member bottom portion.

In one embodiment, at least some groups of consecutive tongue members include tongue members that extend alternately towards said top and said bottom portions of said frame member.

In one embodiment, said frame member is made of aluminium.

In one embodiment, a number of said tongue members extend from said load-bearing portion into slots made through said frame member between said top and bottom portions thereof.

In one embodiment, a number of other tongue members than those that extend into said slots extend towards said bottom portion of said frame member.

In one embodiment, at least some groups of consecutive tongue members include tongue members that extend alternately into said slots and towards said bottom portion of said frame member.

In one embodiment, said frame member is made of wood.

In one embodiment, said decking is unitary and said tongue members are integrally fixed to said load-bearing portion.

DESCRIPTION OF THE DRAWINGS

In the annexed drawings

DETAILED DESCRIPTION OF THE EMBODIMENTS

Figure 1:
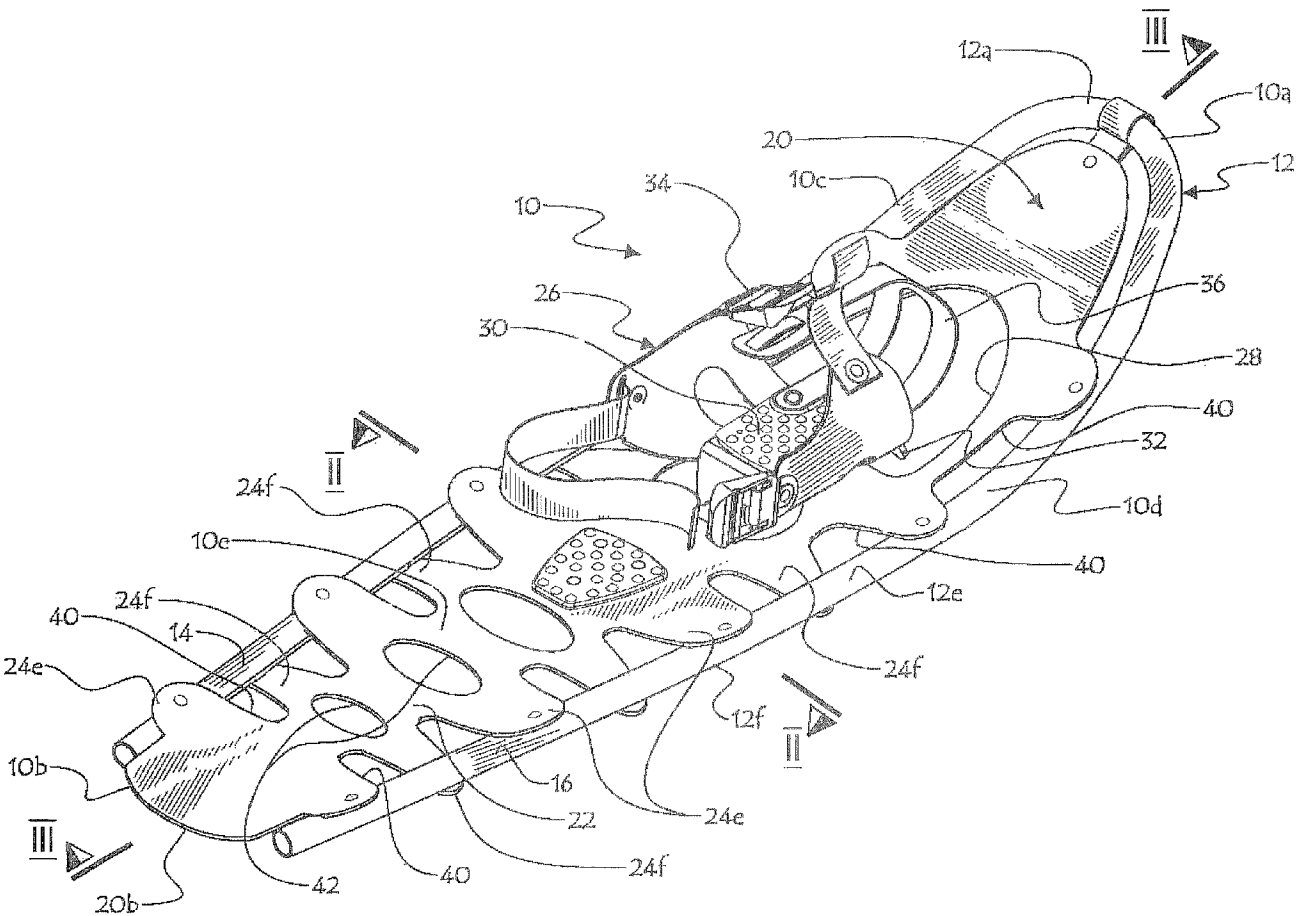
FIG. 1 is a top perspective view of a snowshoe according to one embodiment of the present invention.
Figure 2:
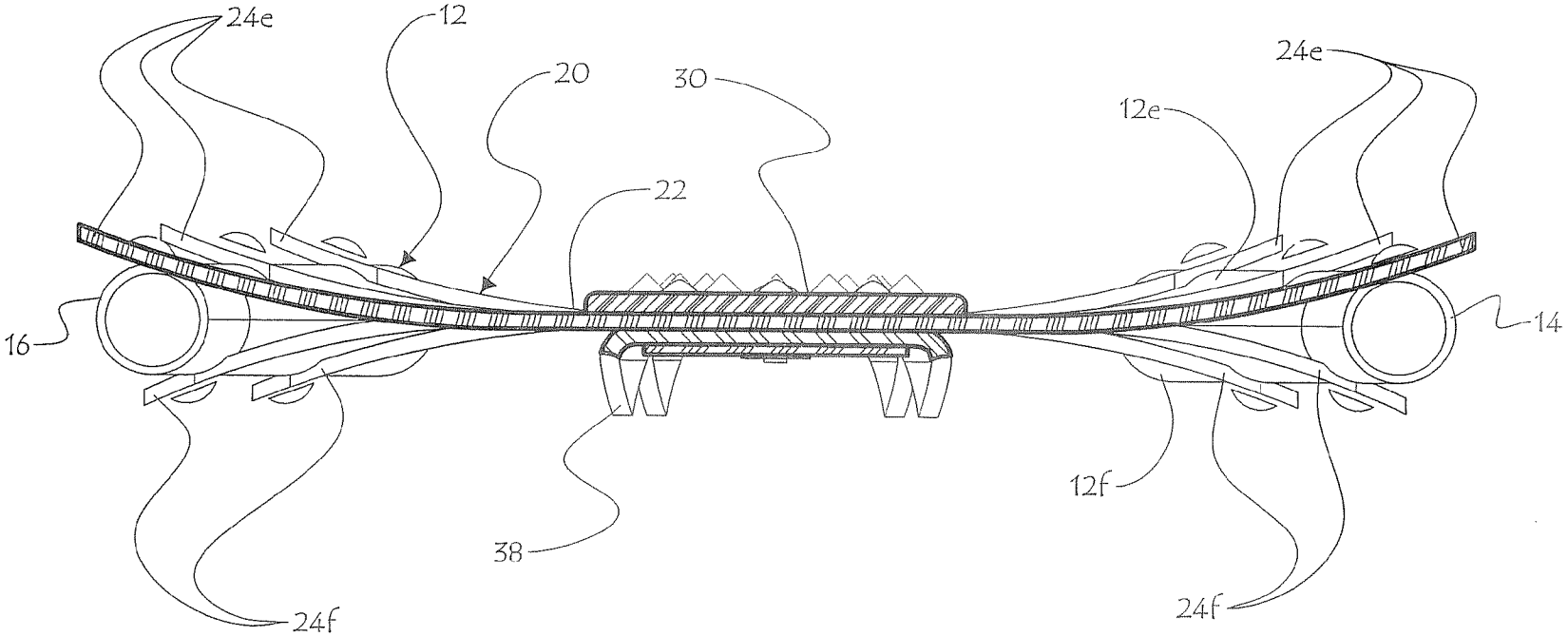
FIGS. 2 and 3 are cross-sectional elevations respectively taken along lines II-II and III-III of FIG. 1.
Figure 3:
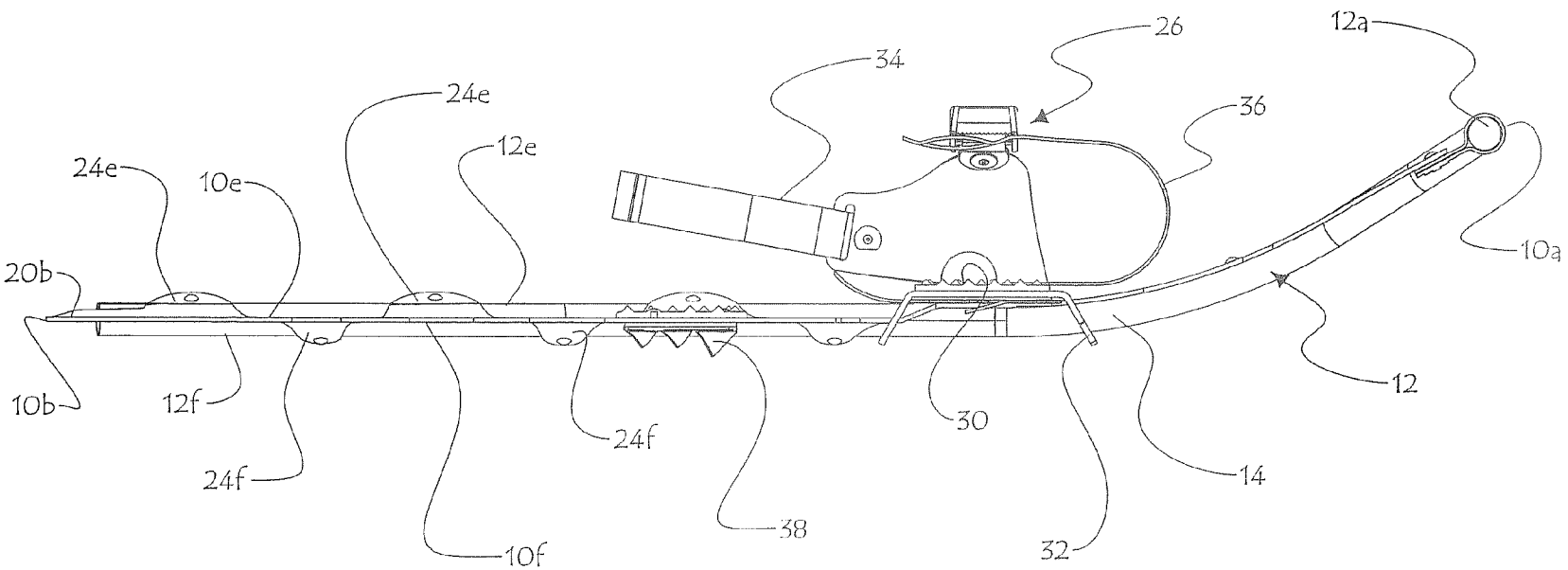

FIGS. 1-3 show a snowshoe 10 according to one embodiment of the present invention. Snowshoe 10 defines opposite front and rear ends 10*a*, 10*b*, opposite first and second sides 10*c*, 10*d* and opposite top and bottom surfaces 10*e*, 10*f*. Snowshoe 10 comprises a rigid peripheral frame member 12 comprising a top portion 12*e* corresponding to top surface 10*e* of snowshoe 10 and a bottom portion 12*f* corresponding to bottom surface 10*f* of snowshoe 10.

Frame member 12 is U-shaped in the embodiment shown in FIGS. 1-3 and is made from a bent aluminium tube, although it is understood that frame member 12 could be made in other shapes and from other materials, as will be further exemplified hereinafter. In the embodiment of FIG. 1-3, frame member 12 comprises first and second elongated generally parallel side bars 14, 16 respectively located on the snowshoe first and second sides 10*c*, 10*d* and integrally linked by an arcuate front frame tip portion 12*a*. Frame member 12 defines a gap near the rear end 10*b* of snowshoe 10 between first and second side bars 14, 16 in that no transverse rear frame bar is provided.

Frame member 12 has a thickness defined between its top and bottom portions 12*e*, 12*f*. This thickness is constant and equal to the diameter of the tube used to form frame member 12 in the embodiment of FIGS. 1-3, but it is understood that this thickness could alternately vary along the length of frame member 12 if it had an irregular shape.

Snowshoe 10 further comprises a decking 20 that comprises a central load-bearing portion 22 and a number of tongue members 24*e*, 24*f* that will be collectively referred to as tongue members 24. Tongue members 24 are fixed to load-bearing portion 22 at a first extremity and attached to frame member 12 at another extremity. More particularly, decking 20 is unitary and consequently tongue members 24 integrally extend from load-bearing portion 22. Tongue members may be attached to frame member 12 in any suitable manner, for example with pins, bolts, tie wraps, strings, screws, rivets, glue or any other suitable attachment means, whereby frame member 12 carries decking 20. Decking 20 defines a free rear edge 20*b* which is not attached to frame member 12 at the read end 10*b* of snowshoe 10.

Decking 20 is at least semi-rigid, in that it cannot be made entirely flexible but it could be semi-rigid or rigid. Semi-rigid deckings are usually preferable since it is usually desirable to have the decking yield and flex slightly under a person's load during use, but the rigidity of the decking is a design choice that might result in a more rigid decking being used. In any event, considering that decking 20 is relatively thin, and desirably so, it is likely to at least slightly flex under a person's weight whatever the material used. For example, semi-rigid plastic may be used for decking 20.

A harness 26 is attached to either one of decking 20 and frame member 12 for allowing a person's foot to be releasably attached to snowshoe 10. More particularly, in the embodiment of FIGS. 1-3, decking 20 comprises a toe hole 28 for allowing the person's foot attached to the snowshoe with harness 26 to extend cyclically under and over decking 20 by pivoting into and out of toe hole 28 during gait, as known in the art. Harness 26 is consequently pivotally attached to decking 20 on a toe hole edge portion thereof. Harness 26 conventionally comprises a rigid toe plate 30 pivotally carried by decking 20 and on which the foot will rest. Toe plate is bent to form a claw plate 32 at its extremity that protrudes in toe hole 28. A buckle assembly 34 comprising front buckles and a heel buckle allows the user's foot to be releasably attached to harness 26. A rigid or semi-rigid front toe guard 36 protects the user's toes.

Snowshoe 10 further conventionally comprises a toothed heel gripping member 38 fixed underneath decking 20.

According to the present invention, it can be noted that tongue members 24 have a staggered attachment configuration relative to the thickness of frame member 12. That is to say that tongue members are offset relative to one another along an axis which is generally perpendicular to decking 20.

More particularly, is will be noted that a number of tongue members 24*e* extend from the decking load-bearing portion 22 in a slightly upward direction towards the frame member top portion 12*e* while a number of other tongue members 24*f* extend from the decking load-bearing portion 22 slightly downward towards the frame member bottom portion 12*f*. By thus orienting tongue members 24*e* and 24*f* respectively upwardly over frame member 12 and downwardly under frame member 12, the above-mentioned staggered configuration is obtained, relative to the thickness of frame member 12. It will be noted that although the upwardly-oriented tongue members 24*e* in the embodiment shown in FIGS. 1-3 are also attached on the frame member top portion 12*e*, they could alternately extend upwardly over frame member 12, be partly wrapped around frame member 12 and be attached to the frame member bottom portion 12*f*. The key element is their orientation as they extend from decking 20 and not necessarily where they are attached. The same is true for the downwardly-oriented tongue members 24*f*: they could extend downwardly, be partly wrapped around frame member 12 and be attached to its top portion 12*e*.

It can be seen in FIGS. 1-3 that at least some groups of consecutive tongue members 24 include tongue members 24*e*, 24*f* that extend alternately towards the top and bottom portions 12*e*, 12*f* of frame member 12. For example, this alternation can be seen along almost the entire length in the embodiment of FIGS. 1-3 where, along each one of side bars 14 and 16, the rearmost tongue member 24 is an upwardly-oriented tongue member 24*e*; the frontwardly adjacent tongue member 24 is a downwardly-oriented tongue member 24*f*, the is next tongue member 24 is an upwardly-oriented tongue member 24*e*; the following one, a downwardly-oriented tongue member 24*f*; and so on. This alternation is repeated up to and excluding the frontmost tongue member 24 which is an upwardly-oriented tongue member 24*e* which follows another upwardly-oriented tongue member 24*e*.

This feature of the tongue member orientation alternation is optional, but provides interesting properties to snowshoe 10 as will be detailed hereinafter. Snowshoe 10 could indeed be provided with series of adjacent upwardly-oriented tongue members 24*e* and series of adjacent downwardly-oriented tongue members 24*f* in a regular or irregular array without departing from the scope of the present invention. Since both the downwardly-oriented and the upwardly-oriented tongue members 24*f* and 24*e* would still be provided and consequently the tongue members 24 would still be misaligned, they would still be considered to present a staggered configuration.

In the embodiment shown in FIGS. 1-3, tongue members 24 are spaced-apart tangentially along frame member 12 and openings 40 are consequently defined between the spaced-apart tongue members 24. It is noted that none or only some of the tongue members 24 could be spaced-apart.

Other central openings 42 can optionally be provided on decking 20.

The staggered configuration of tongue members 24 provides at least two important advantages to snowshoe 10.

Firstly, snowshoe 10 has an enhanced grip on the snow when snowshoe 10 rests on the ground. Indeed, as snowshoe 10 is applied on the ground and especially when snowshoe 10 is loaded with a person's weight, it will at least slightly sink in the snow and consequently some snow will be located between consecutive downwardly-oriented tongue is members 24*f* and be compacted underneath upwardly-oriented tongue members 24*e*. When the user leans against his snowshoe 10 to move forward during a step, he will in fact push back against the snowshoe. The downwardly-oriented tongue members 24*f* will then abut with their edges against the snow located rearwardly of tongue members 24*f* to increase the gripping effect of the snowshoe 10. Thus, the staggered configuration of tongue members 24 will contribute to help prevent sliding of the snowshoe on the snow in combination with other known structures that have this purpose such as the heel gripping member 38 and the toe plate claw 32.

However helpful in increasing the gripping effect of snowshoe 10 the staggered configuration of tongue members 24 may be, it will not hinder the snowshoe when it is carried frontwardly by the foot during the forward movement thereof during a step. This is due to the fact that the snowshoe will be lifted above ground during that portion of the step and, alike the toothed heel gripping member 38 and the toe plate claw 32, the tongue members 24 will not slide along the ground but rather be carried spacedly over it.

Secondly, a very unexpected and advantageous result stems from the staggered configuration of tongue members 24: the rigidity of the entire snowshoe 10 is increased. Indeed, under a person's load, the upwardly-oriented tongue members 24*e* will be tensioned while the downwardly-oriented tongue members 24*f* will be compressed. This is due to the semi-rigid nature of decking 20 and to the staggered configuration of tongue members 24 which will incur outwardly-oriented forces in the downwardly-oriented tongue members

24*f* and inwardly-oriented forces in the upwardly-oriented tongue members 24*e*. The outward force exerted by the downwardly-oriented tongue members 24*f* will help maintain the frame side bars 14, 16 in position, i.e. will help prevent side bars 14, 16 from undesirably flexing inwardly. This consequently helps prevent frame 12 from flexing during gait, which is a highly desirable result.

This is contrary to prior art deckings where all the tongue members or decking attachments are usually upwardly-oriented (or, more generally, all oriented in a same direction, instead of having a staggered configuration): in such a case, all tongue members would be forced inwardly under load, resulting in the frame side bars being undesirably forced inwardly each time the user's weight is applied on the decking. This means that the prior art frames often flex in and out during gait, which makes walking much more difficult; or, in the alternative, much more rigid frames are required, making the snowshoe heavier, bulkier and more expensive.

This unexpected advantage of the snowshoe rigidity being increased is highly interesting for all kinds of snowshoes, but moreso for snowshoes of the type that have an opened-ended peripheral frame 12 such as the one shown in the embodiment of FIGS. 1-3. Indeed, by providing snowshoe 10 with a frame having a gap at the read end of frame member 12, the overall rigidity of frame member 12 is decreased, ceteris paribus. However, this gap is advantageous in that it decreases the friction or drag effect of the snowshoe during gait. It also allows snow to be unloaded more easily from decking 20 by sliding off decking 20 towards the rear end 10*b* of snowshoe 10. It is recalled that a snowshoe will be lifted over ground when the foot is moved forward during a step, but that the rear tail 10*b* of the snowshoe will drag along the ground during that time. Indeed, the front tip 10*a* of the snowshoe must desirably be tilted upwardly to prevent it from diving into the snow or otherwise sliding underneath a tree branch or other ground obstacle, which results in its tail end 10*b* dragging along the ground. Having a transverse frame portion at the snowshoe tail end 10*b* increases the friction of the snowshoe significantly.

As a result, having the staggered configuration of tongue members 24 will in fact mitigate the trade-off that would otherwise have been made: the rigidity of frame member 12 will be significant while still having a frame member 12 devoid of any rear transverse bar and having reasonable dimensions and weight.

Figure 4:
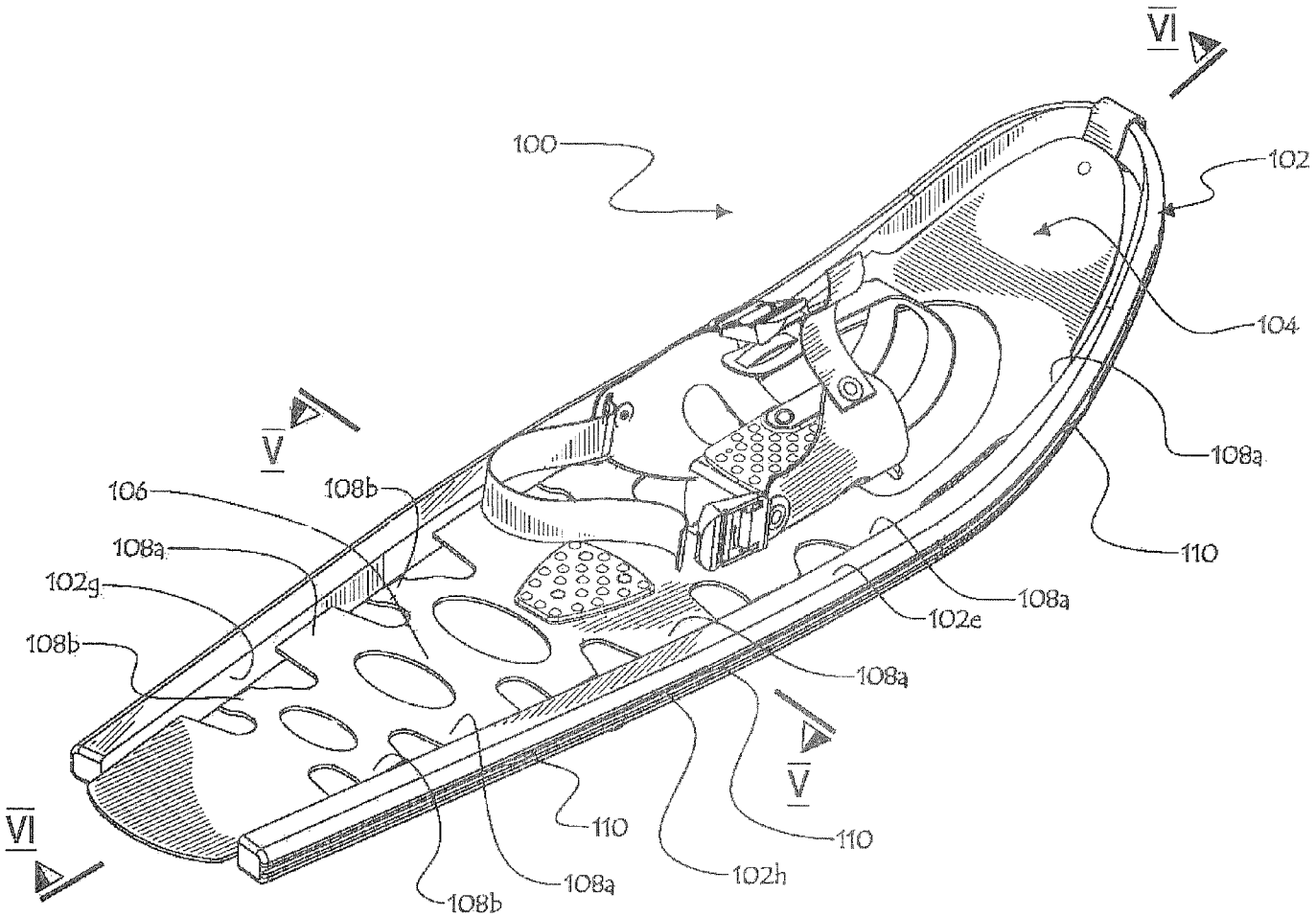
FIG. 4 is a top perspective view of a snowshoe according to another embodiment of the present invention.
Figure 5:
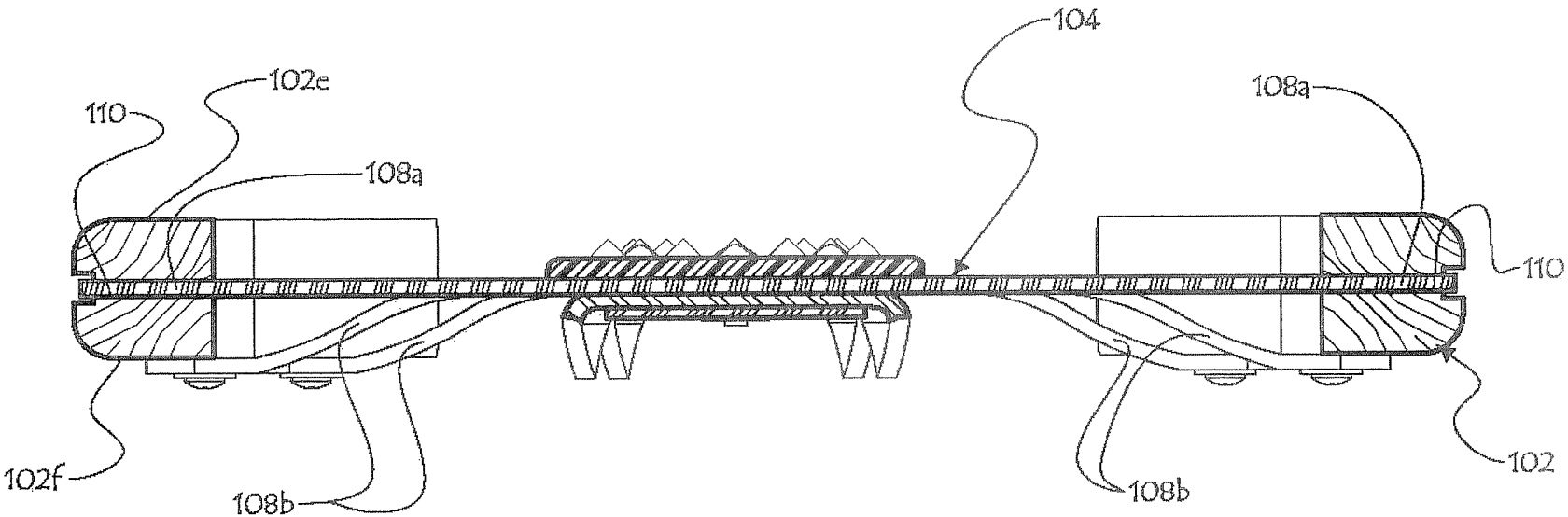
FIGS. 5 and 6 are cross-sectional elevations respectively taken along lines V-V and VI-VI of FIG. 4.
Figure 6:
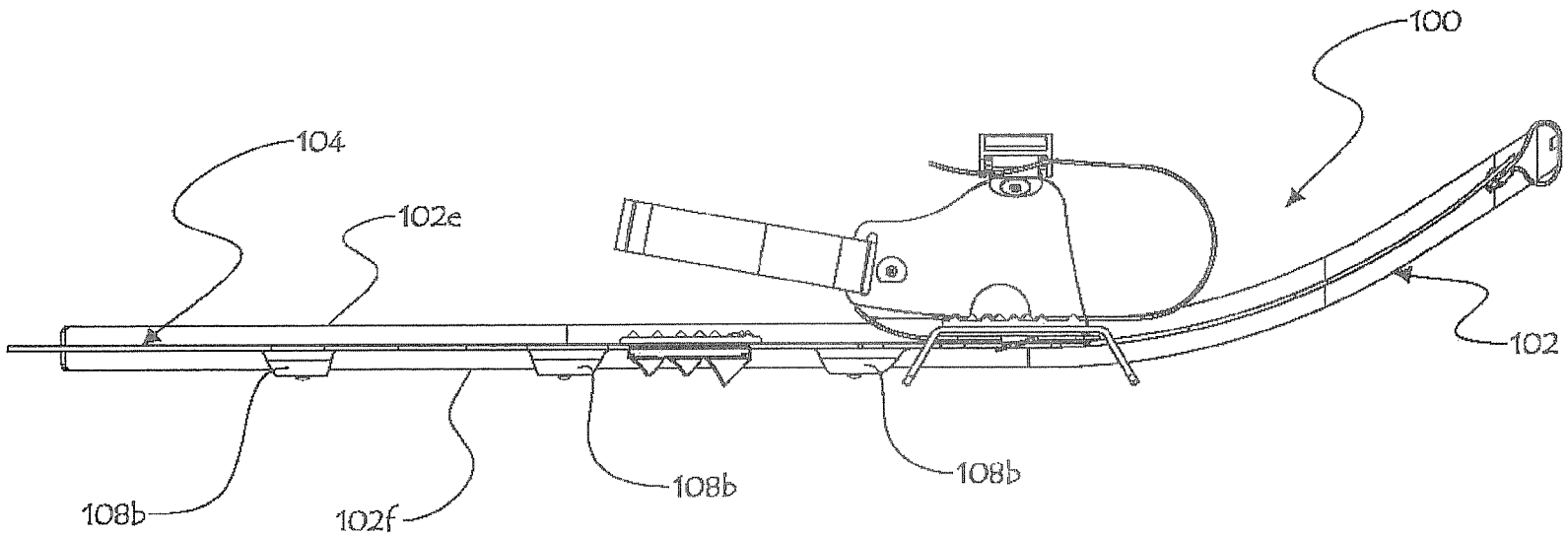

FIGS. 4-6 show a second embodiment of a snowshoe 100 according to the present invention. Snowshoe 100 is similar to snowshoe 10, except as detailed hereinafter.

Snowshoe 100 comprises a generally U-shaped peripheral frame member 102 having an opened rear end and carrying a decking 104 that is at least semi-rigid. Decking 104 comprises a central load-bearing portion 106 and a number of tongue members 108*a*, 108*b* that will be collectively referred to as tongue members 108.

Frame member 102 could be made from any suitable material, but in the example shown in FIGS. 4-6, frame member 102 is made of wood.

Frame member is pierced to form a number of slots 110 that extend through frame member 102 from an inner side thereof 102*g* to an outer side thereof 102*h*, between the frame member top and bottom portions 102*e*, 102*f*.

Tongue members 108 include a number of tongue members 108*a* that extend from the decking load-bearing portion 106 into slots 110 and a number of other tongue members 108*b* than those that extend into slots 110 that extend towards the bottom portion 102*f* of frame member 102. Tongue members 108*a* are fixed inside slots 110.

The embodiment of FIGS. 4-6 consequently shows another type of staggered configuration of tongue members 108 which still provides the desired advantages detailed hereinabove.

The invention claimed is:

1. A snowshoe defining opposite front and rear ends, opposite first and second sides and opposite top and bottom surfaces and comprising:

a rigid peripheral frame member comprising a top portion corresponding to said top surface of said snowshoe and a bottom portion corresponding to said bottom surface of said snowshoe and having a frame member thickness defined between said top and bottom portions;

a decking that is at least semi-rigid and that comprises a central load-bearing portion and a number of tongue members fixed to said load-bearing portion and attached to said frame member whereby said frame member carries said decking; and a harness pivotally attached to either one of said decking and said frame member for allowing a person's foot to be releasably attached to said snowshoe;

wherein said tongue members have a staggered attachment configuration relative to the thickness of said frame member and wherein at least some groups of consecutive tongue members include tongue members that extend alternately towards said top and said bottom portions of said frame member.

2. A snowshoe as defined in claim 1, wherein said frame member is U-shaped and comprises first and second elongated generally parallel side bars respectively located on said snowshoe first and second sides and integrally linked by an arcuate front frame tip portion, said frame member defining a gap near said rear end of said snowshoe between said first and second side bars, said decking defining a free rear edge which is not attached to said frame member at said read end of said snowshoe.

3. A snowshoe as defined in claim 1, wherein said decking comprises a toe hole for allowing the person's foot attached to the snowshoe with said harness to extend cyclically under and over said decking by pivoting into and out of said toe hole during gait.

4. A snowshoe as defined in claim 3, wherein said harness is pivotally attached to said decking on a toe hole edge portion thereof.

5. A snowshoe as defined in claim 1, wherein at least sonic of said tongue members are spaced-apart tangentially along said frame member and openings are consequently defined between said at least some spaced-apart tongue members.

6. A snowshoe as defined in claim 1, wherein a number of said tongue members extend from said load-bearing portion towards said frame member top portion while a number of other said tongue members extend from said load-bearing portion towards said frame member bottom portion.

7. A snowshoe as defined in claim 1, wherein said frame member is made of aluminium.

8. A snowshoe as defined in claim 1, wherein said decking is unitary and said tongue members are integrally fixed to said load-bearing portion.

9. A snowshoe defining opposite front and rear ends, opposite first and second sides and opposite top and bottom surfaces and comprising:

a rigid peripheral frame member comprising a top portion corresponding to said top surface of said snowshoe and a bottom portion corresponding to said bottom surface of said snowshoe and having a frame member thickness defined between said top and bottom portions;

a decking that is at least semi-rigid and that comprises a central load-bearing portion and a number of tongue members fixed to said load-bearing portion and attached to said frame member whereby said frame member carries said decking; and a harness pivotally attached to either one of said decking and said frame member for allowing a person's foot to be releasably attached to said snowshoe;

wherein said tongue members have a staggered attachment configuration relative to the thickness of said frame member, a number of said tongue members extending from said load-bearing portion into slots made through said frame member between said top and bottom portions thereof, and wherein a number of other tongue members than those that extend into said slots extend towards said bottom portion of said frame member.

10. A snowshoe as defined in claim 9, wherein at least some groups of consecutive tongue members include tongue members that extend alternately into said slots and towards said bottom portion of said frame member.

11. A snowshoe as defined in claim 10, wherein said frame member is made of wood.

* * * * *